US009850649B2

(12) United States Patent
Watanabe et al.

(10) Patent No.: US 9,850,649 B2
(45) Date of Patent: Dec. 26, 2017

(54) VORTEX FLOW TYPE WATER SURFACE CONTROL DEVICE FOR DRAINING DEVICE

(75) Inventors: Hiromi Watanabe, Kanagawa (JP); Hiroshi Komatsu, Chiba (JP); Shigeki Nishimura, Saitama (JP); Shigeru Tsukada, Saitama (JP)

(73) Assignees: NIPPON KOEI CO., LTD, Tokyo (JP); TOKYO METROPOLITAN SEWERAGE SERVICE CORPORATION, Tokyo (JP); TOKYO METROPOLITAN GOVERNMENT, Tokyo (JP)

( * ) Notice: Subject to any disclaimer, the term of this patent is extended or adjusted under 35 U.S.C. 154(b) by 913 days.

(21) Appl. No.: 13/882,306

(22) PCT Filed: Dec. 9, 2011

(86) PCT No.: PCT/JP2011/079118
§ 371 (c)(1),
(2), (4) Date: Jun. 5, 2013

(87) PCT Pub. No.: WO2012/081685
PCT Pub. Date: Jun. 21, 2012

(65) Prior Publication Data

US 2013/0240421 A1 Sep. 19, 2013

(30) Foreign Application Priority Data

Dec. 14, 2010 (JP) ..... 2010-278329

(51) Int. Cl.
*E03F 5/10* (2006.01)
*E03F 5/12* (2006.01)

(52) U.S. Cl.
CPC ..... *E03F 5/105* (2013.01); *E03F 5/125* (2013.01); *E03F 5/106* (2013.01)

(58) Field of Classification Search
None
See application file for complete search history.

(56) References Cited

U.S. PATENT DOCUMENTS 7,138,048 B1 * 11/2006 O'Connor ..... E03F 5/14 210/136
8,459,900 B2 * 6/2013 Uemura ..... E03F 5/12 210/170.03
2008/0023074 A1 * 1/2008 Uemura ..... E03F 5/12 137/237

FOREIGN PATENT DOCUMENTS

DE 20112168 * 1/2002 ..... E03F 5/10
EP 1783286 5/2007
(Continued)

OTHER PUBLICATIONS

Title: DE20112168 translation (Baffle before overflow thresholds of sewer overflows in combined sewers) Author: Gebert Heinz (machine translation) Date: Jan. 2002 Publisher: Espacenet.*
(Continued)

*Primary Examiner* — Bobby Ramdhanie
*Assistant Examiner* — Michael An
(74) *Attorney, Agent, or Firm* — Greenblum & Bernstein, P.L.C.

(57) ABSTRACT

A control plate is provided at a preferred position in a storm overflow chamber. An inflow pipe, an intercepting pipe, and an outflow pipe are connected to the storm overflow chamber. A vortex flow type water surface control device for a draining device includes the overflow chamber, and a control plate arranged in front of an opening portion of the intercepting pipe opening to the storm overflow chamber. A relation (1) 0.5 D≤X≤0.7 D and 0.83 D≤Y≤1.5 D holds true, or a relation (2) 0.4 D≤X≤0.5 D and 1.0 D≤Y≤1.5 D holds true, where D represents an inner diameter of the opening portion, X represents a projection length of the control plate
(Continued)

with respect to the opening portion, and Y represents a distance between the control plate and the opening portion. As a result, contaminants enter the intercepting pipe.

9 Claims, 2 Drawing Sheets

(56) References Cited

FOREIGN PATENT DOCUMENTS

| | | |
|---|---|---|
| JP | 2004-238833 | 8/2004 |
| WO | 2006/013634 | 2/2006 |

OTHER PUBLICATIONS

Title: Hydrospin Floatables Removal Author: Steinhardt Date: Oct. 2010.*

NPL-1 Title: Water surface control device for countermeasures against contaminants in improvement of combined sewer system Publisher: Japan Institute of Wastewater Engineering and Technology Date: 2009.*

Date for Steinhard GmbH, Hydrospin video, Oct. 18, 2010, pp. 1 and 2.*

"Goryushiki Gesuido no Kaizen ni Okeru Kyozatsubutsu Taisaku o Taisho to shita Suimen Seigyo Sochi Gijutsu Shiryo—2009 Nen 3 Gatsu—", Japan Institute of Wastewater Engineering Technology, Mar. 31, 2009, pp. 37-38, 49, 64-66, with English language translation.

Abe, "Gesuido Leading Company, Tokyo-To Gesuido Service Gutai no Katsudo to Kongo no Tenkai Seko Gijutsu Bunya—Goryu Kaizen Gijutsu Suimen Seigyo Sochi", Journal of Sewerage Monthly, vol. 29, No. 3, Kankyoshimbunsya Co., Ltd., Feb. 15, 2005, pp. 50-51.

Kasuga et al., "Goryu kaizen Shisetsu (Usuibakguchi Kyozatsubutsu Taisaku) no Seino Kakunin Chosa ni Tsuite", Tokyo-To Kankyo Gyosei Koryukaishi, Jul. 4, 2006, No. 29, Heisei 17 Nendo, pp. 53-56.

"Goryushiki Gesuido Usuibaki Kara no Kyozatsubutsu Sakugen Taisaku", Nihon Suido Consultants Co., Ltd., Apr. 27, 2006, htpp://web.archive.org/web/20060427202818/http://www.nissuicon.co.jp/service/gesui/usuibaki.html.

"Goryushiki Gesuido Usuibaki kara no Kyozatsubutsu Sakugen Taisaku", Nihon Suido Consultants, Co., Ltd., May 13, 2006, http://web.archive.org/web/20060427202818/http://www.nissuicon.co.jp/service/gesui/usuibaki.html, Nai no 'Gyoryushiki Gesuido Usuibaki kara no Kyozatsubutsu Sakugen Taisaku (279KB)' Link Saki, http://web.archive.org/web/20060513200320/http://www.nissuicon.co.jp/service/gesui/pdf/usuibaki.pdf.

Search report from E.P.O., dated Jun. 12, 2015.

* cited by examiner

VORTEX FLOW TYPE WATER SURFACE CONTROL DEVICE FOR DRAINING DEVICE

TECHNICAL FIELD

The present invention particularly relates to a device that restrains contaminants flowing out to rivers and the like inside a storm overflow chamber that separates wastewater and rainwater from each other, in a combined sewer system that applies drainage treatment to rainwater and wastewater in the same sewer.

BACKGROUND ART

As countermeasures against the flowing out of contaminants in the storm overflow chamber, a vertical control plate 6 as described in Patent Document 1 (JP 2004-238833 A) (refer to Abstract and FIG. 1) is known. The vertical control plate 6 generates a vortex near an opening of an intercepting pipe 3. Floating contaminants 5 are drawn into the vortex, and then contaminants 5 are drawn into the intercepting pipe 3.

SUMMARY OF THE INVENTION

However, it is not always clear where the vertical control plate 6 should be arranged to facilitate the drawing of the contaminants 5 into the intercepting pipe 3.

It is therefore an object of the present invention to provide the control plate at a preferred position in the storm overflow chamber.

According to the present invention, a vortex flow type water surface control device for a draining device includes: a storm overflow chamber that is connected to an inflow pipe, an intercepting pipe, and an outflow pipe; and a control plate that is arranged in front of an opening portion of the intercepting pipe opening to the storm overflow chamber, wherein a relation (1) $0.5\ D \leq X \leq 0.7\ D$ and $0.83\ D \leq Y \leq 1.5\ D$ holds true, or a relation (2) $0.4\ D \leq X \leq 0.5\ D$ and $1.0\ D \leq Y \leq 1.5\ D$ holds true, where D represents an inner diameter of the opening portion, X represents a projection length of the control plate with respect to the opening portion, and Y represents a distance between the control plate and the opening portion.

The thus constructed vortex flow type water surface control device for a draining device includes a storm overflow chamber that is connected to an inflow pipe, an intercepting pipe, and an outflow pipe. A control plate is arranged in front of an opening portion of the intercepting pipe opening to the storm overflow chamber. A relation (1) $0.5\ D \leq X \leq 0.7\ D$ and $0.83\ D \leq Y \leq 1.5\ D$ holds true, or a relation (2) $0.4\ D \leq X \leq 0.5\ D$ and $1.0\ D \leq Y \leq 1.5\ D$ holds true, where D represents an inner diameter of the opening portion, X represents a projection length of the control plate with respect to the opening portion, and Y represents a distance between the control plate and the opening portion.

According to the present invention, a vortex flow type water surface control device for a draining device includes: a storm overflow chamber that is connected to an inflow pipe, an intercepting pipe, and an outflow pipe; and a control plate that is arranged in front of an opening portion of the intercepting pipe opening to the storm overflow chamber, wherein a relation $0.4\ D \leq X \leq 0.7\ D$ holds true, where D represents an inner diameter of the opening portion, and X represents a projection length of the control plate with respect to the opening portion.

According to the present invention, a vortex flow type water surface control device for a draining device includes: a storm overflow chamber that is connected to an inflow pipe, an intercepting pipe, and an outflow pipe; and a control plate that is arranged in front of an opening portion of the intercepting pipe opening to the storm overflow chamber, wherein a relation $0.83\ D \leq Y \leq 1.5\ D$ holds true, where D represents an inner diameter of the opening portion, and Y represents a distance between the control plate and the opening portion.

According to the vortex flow type water surface control device for a draining device of the present invention, the storm overflow chamber may include a separating weir for separating the inflow pipe and the intercepting pipe from the outflow pipe.

According to the present invention, the vortex flow type water surface control device for a draining device may include a guide wall that separates the inflow pipe and the intercepting pipe from the outflow pipe, wherein a top end of the guide wall is higher than a top end of the separating weir.

MODES FOR CARRYING OUT THE INVENTION

A description will now be given of an embodiment of the present invention referring to drawings.

Figure 1:
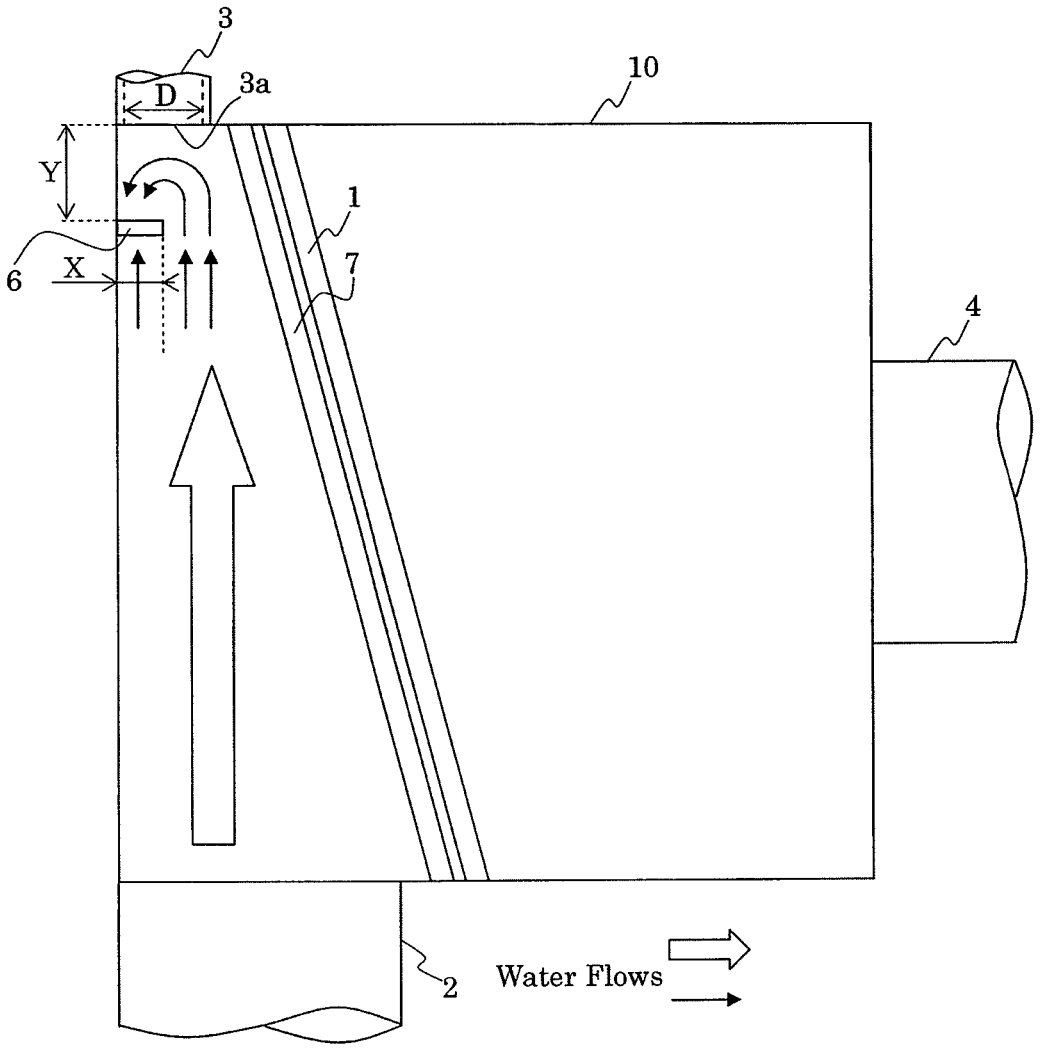
FIG. 1 is a plan view of a storm overflow chamber 10 according to an embodiment of the present invention.
Figure 2:
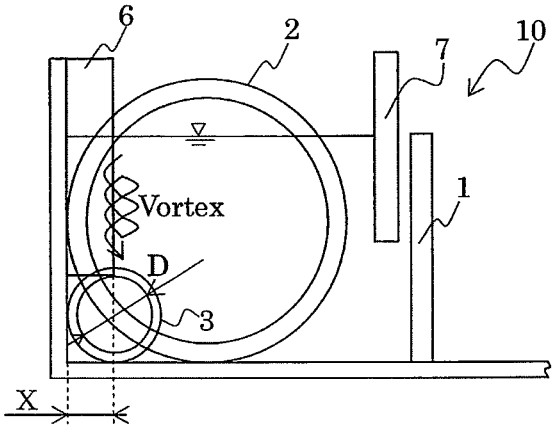
FIG. 2 is a front perspective view of the storm overflow chamber 10 according to an embodiment of the present invention.

FIG. 1 is a plan view of a storm overflow chamber 10 according to an embodiment of the present invention. FIG. 2 is a front perspective view of the storm overflow chamber 10 according to an embodiment of the present invention. It should be noted that a neighborhood of an outflow pipe 4 is omitted in FIG. 2.

An inflow pipe 2, an intercepting pipe 3, and the outflow pipe 4 are connected to the storm overflow chamber 10. Inflow water such as household wastewater, wastewater, and rainwater flows in the inflow pipe 2, and flows into the storm overflow chamber 10. The inflow water which has flown into the storm overflow chamber 10 is guided by the intercepting pipe 3 to a sewage treatment plant.

Although the inflow pipe 2, the intercepting pipe 3, and the outflow pipe 4 are arranged as described below in FIG. 1, they are not necessarily so arranged. An extension direction of the inflow pipe 2 and an extension direction of the intercepting pipe 3 are the same. An extension direction of the outflow pipe 4 is orthogonal to the extension directions of the inflow pipe 2 and the intercepting pipe 3. An opening of the inflow pipe 2 and an opening of the intercepting pipe 3 face each other in parallel. An opening of the outflow pipe 4 is arranged on the right side seen from the opening of the inflow pipe 2. The openings of the inflow pipe 2 and the intercepting pipe 3 are arranged on the left side of the storm overflow chamber 10. The opening of the outflow pipe 4 is arranged on the right side of the storm overflow chamber 10.

A separating weir 1 separates the inflow pipe 2 and the intercepting pipe 3 from the outflow pipe 4. The inflow water which has overflown the separating weir 1 due to an increase of the inflow water during rainfall or the like is discharged through the outflow pipe 4 to a river or the like.

An opening portion of the intercepting pipe 3 opening to the storm overflow chamber 10 is referred to as an opening portion 3*a*. A control plate 6 is arranged in front of the opening portion 3*a*. Although a bottom end of the control plate 6 is arranged as high as a top portion of the intercepting pipe 3, for example, they are not necessarily limited to the same height.

A guide wall 7 separates the inflow pipe 2 and the intercepting pipe 3 from the outflow pipe 4. A bottom end of the guide wall 7 is arranged slightly lower than a top end of the separating weir 1. A top end of the guide wall 7 is higher than a top end of the separating weir 1.

A vortex flow type water surface control device for a draining device according to an embodiment of the present invention includes the storm overflow chamber 10, the control plate 6, and the guide wall 7. The storm overflow chamber 10 includes the separating weir 1.

A description will now be given of a state of water flows in the storm overflow chamber 10 according to an embodiment of the present invention.

Arrows shown in FIG. 1 represent flows of the inflow water flowing from the inflow pipe 2. The inflow water flows toward the intercepting pipe 3. Now, it is assumed that the water level of the inflow water is increased due to rainfall or the like, and exceeds the bottom end of the control plate 6 to a certain extent. Then, a part of the inflow water is blocked by the control plate 6. Further, the control plate 6 and the separating weir 1 are separated from each other, and the inflow water which has flown in this portion tends to flow around the control plate 6. As a result, a vortex is generated in the neighborhood of the control plate 6. The vortex draws contaminants floating on the inflow water thereinto. The contaminants which have been drawn into the vortex are then drawn into the intercepting pipe 3.

On this occasion, Y represents a distance (referred to as "arrangement position") between the control plate 6 and the opening portion 3*a* (or an inner wall surface of the storm overflow chamber 10 to which the intercepting pipe 3 opens). X represents a length in which the control plate 6 is projected with respect to the opening 3*a* (referred to as "projection length"). It should be noted that the projection length X is considered to be a distance between a right end of the control plate 6 and a left end of the opening portion 3*a* referring to FIG. 2. Moreover, D represents an inner diameter of the opening portion 3*a*.

Table 1 shows experiment results in which it is determined whether contaminants flow into the intercepting pipe 3 or not for various values of the projection length X and the arrangement position Y.

TABLE 1

| Arrangement position Y | Projection length X 0.3D | 0.4D | 0.5D | 0.6D | 0.7D |
|---|---|---|---|---|---|
| 0.83D | x | x | Δ | Δ | ○ |
| 1.0D | x | Δ | ○ | ○ | ○ |
| 1.5D | x | Δ | Δ | Δ | Δ |
| 2.0D | x | x | x | x | x |

Note)
Symbols represent how contaminants are drawn into the intercepting pipe as follows.
x: Do not flow into the intercepting pipe.
Δ: Gradually flow into the intercepting pipe.
○: Continuously flow into the intercepting pipe.

From the experiment result, it is appreciated that, preferably:

a relation (1) $0.5\ D \le X \le 0.7\ D$ and $0.83\ D \le Y \le 1.5\ D$ holds true, or a relation (2) $0.4\ D \le X \le 0.5\ D$ and $1.0\ D \le Y \le 1.5\ D$ holds true.

If the projection length X is less than 0.4 D or 0.5 D, an effect of blocking the flow toward the intercepting pipe 3 is not sufficiently provided, and a vortex strong enough to draw contaminants thereinto is generated with less possibility. If the projection length X exceeds 0.7 D, a material cost of the control plate 6 increases. Moreover, the gap between the control plate 6 and the separating weir 1 is reduced, and a problem occurs that contaminants are caught therebetween.

If the arrangement position Y exceeds 1.5 D, the position where the vortex is generated becomes too far from the opening portion 3*a* of the intercepting pipe 3 to draw contaminants into the intercepting pipe 3. If the arrangement position Y is less than 0.83 D or 1.0 D, there poses such a problem that contaminants are caught between the control plate 6 and the inner wall surface of the storm overflow chamber 10 to which the intercepting pipe 3 opens.

If the water level of the inflow water exceeds the top end of the separating weir 1, the water surface bulges upward near the guide wall 7, and a water surface gradient from the inflow pipe 2 to the separating weir 1 is not formed. As a result, contaminants flow along the guide wall 7, and are guided to the neighborhood of the opening portion 3*a*. The guided contaminants are drawn into the vortex generated with the control plate 6, and then flow into the intercepting pipe 3, resulting in an increased efficiency of drawing contaminants.

The invention claimed is:

1. A vortex flow type water surface control device for a draining device comprising:

a storm overflow chamber that is connected to an inflow pipe, an intercepting pipe, and an outflow pipe; and a control plate that is arranged in front of an opening portion of the intercepting pipe opening to the storm overflow chamber, wherein a relation $0.5\ D \le X \le 0.6\ D$ and $0.83\ D \le Y \le 1.5\ D$ holds true, where D represents an inner diameter of the opening portion, X represents a projection length of the control plate from an edge of the opening portion, and Y represents a distance between the control plate and the opening portion.

2. The vortex flow type water surface control device for a draining device according to claim 1, wherein the storm overflow chamber includes a separating weir for separating the inflow pipe and the intercepting pipe from the outflow pipe.

3. The vortex flow type water surface control device for a draining device according to claim 2, comprising a guide wall that separates the inflow pipe and the intercepting pipe from the outflow pipe, wherein a top end of the guide wall is higher than a top end of the separating weir.

4. A vortex flow type water surface control device for a draining device comprising:

a storm overflow chamber that is connected to an inflow pipe, an intercepting pipe, and an outflow pipe; and a control plate that is arranged in front of an opening portion of the intercepting pipe opening to the storm overflow chamber, wherein a relation $0.4\ D \le X \le 0.5\ D$ and $1.0\ D \le Y \le 1.5\ D$ holds true, where D represents an inner diameter of the opening portion, X represents a projection length of the control plate from an edge of the opening portion, and Y represents a distance between the control plate and the opening portion.

5. The vortex flow type water surface control device for a draining device according to claim 4, wherein the storm overflow chamber includes a separating weir for separating the inflow pipe and the intercepting pipe from the outflow pipe.

6. The vortex flow type water surface control device for a draining device according to claim 5, comprising a guide wall that separates the inflow pipe and the intercepting pipe from the outflow pipe, wherein a top end of the guide wall is higher than a top end of the separating weir.

7. A vortex flow type water surface control device for a draining device comprising:

a storm overflow chamber that is connected to an inflow pipe, an intercepting pipe, and an outflow pipe; and a control plate that is arranged in front of an opening portion of the intercepting pipe opening to the storm overflow chamber, wherein a relation $0.5\ D \leq X \leq 0.6\ D$ and $0.83\ D \leq Y \leq 1.0\ D$ holds true, D represents an inner diameter of the opening portion, X represents a projection length of the control plate from an edge of the opening portion, and Y represents a distance between the control plate and the opening portion.

8. The vortex flow type water surface control device for a draining device according to claim 7, wherein the storm overflow chamber includes a separating weir for separating the inflow pipe and the intercepting pipe from the outflow pipe.

9. The vortex flow type water surface control device for a draining device according to claim 8, comprising a guide wall that separates the inflow pipe and the intercepting pipe from the outflow pipe, wherein a top end of the guide wall is higher than a top end of the separating weir.

* * * * *